US009316367B2

(12) United States Patent
Draper et al.

(10) Patent No.: US 9,316,367 B2
(45) Date of Patent: Apr. 19, 2016

(54) MULTI-FUEL LANTERN

(71) Applicants: George E. Draper, New Port Richey, FL (US); Julia Clifton-Draper, New Port Richey, FL (US)

(72) Inventors: George E. Draper, New Port Richey, FL (US); Julia Clifton-Draper, New Port Richey, FL (US)

( * ) Notice: Subject to any disclaimer, the term of this patent is extended or adjusted under 35 U.S.C. 154(b) by 501 days.

(21) Appl. No.: 13/865,385

(22) Filed: Apr. 18, 2013

(65) Prior Publication Data

US 2014/0313702 A1 Oct. 23, 2014

(51) Int. Cl.

| | |
|---|---|
| ***F21L 19/00*** | (2006.01) |
| ***F23D 11/24*** | (2006.01) |
| ***F21V 37/00*** | (2006.01) |
| *F21H 1/00* | (2006.01) |
| *F21V 37/02* | (2006.01) |

(52) U.S. Cl.

CPC ..... *F21L 19/00* (2013.01); *F21V 37/0004* (2013.01); *F23D 11/24* (2013.01)

(58) Field of Classification Search

CPC .... F21L 19/00; F21L 19/006; F21V 37/0004; F21V 37/02; F23D 11/24; F23D 5/04; F21H 1/04

USPC ..... 431/356, 109, 100, 103, 231, 277; 362/159, 179, 180, 266, 296.01

IPC .... F24H 1/00; F21V 37/02; F23D 11/24; F23D 5/04

See application file for complete search history.

(56) References Cited

U.S. PATENT DOCUMENTS

| | | | | | |
|---|---|---|---|---|---|
| 95,498 | A | * | 10/1869 | Maxin et al. | F23D 14/66 431/103 |
| 336,574 | A | * | 2/1886 | Leede | F23C 9/00 431/115 |
| 457,934 | A | | 8/1891 | Craig | |
| 1,026,684 | A | * | 5/1912 | Lauer | F21L 19/00 362/159 |
| 1,303,462 | A | * | 5/1919 | Coleman | F21L 19/00 126/240 |
| 1,947,194 | A | | 2/1934 | Engh | |
| 2,023,467 | A | * | 12/1935 | Davis | F21H 1/04 431/104 |
| 2,139,819 | A | * | 12/1938 | Graetz | F23D 11/44 239/433 |
| 2,263,659 | A | * | 11/1941 | Tullis | F23D 91/02 362/179 |

(Continued)

FOREIGN PATENT DOCUMENTS

| | | | | | |
|---|---|---|---|---|---|
| CA | 2171777 | C | * | 8/2006 | F21L 19/00 |
| EP | 758071 | A1 | * | 2/1997 | F21L 19/00 |
| IN | WO 2008053497 | A1 | * | 5/2008 | F21L 19/00 |

*Primary Examiner* — Gregory Huson
*Assistant Examiner* — Daniel E Namay
(74) *Attorney, Agent, or Firm* — Edward P. Dutkiewicz

(57) ABSTRACT

A lantern comprising a tank, a chimney, an ignition bowl, and a chimney tube. There is also a mixing subassembly, a fuel line, a nozzle and a chimney cap. There is an igniter subassembly, an outflow subassembly and a pump. The igniter subassembly is angled to the right, and inward, providing more efficient heating of the outflow subassembly upper heating tube and loop. A outflow tube, which carries the fuel, has two external dimensions, which provides for more efficient fuel heating.

15 Claims, 11 Drawing Sheets

(56) References Cited

U.S. PATENT DOCUMENTS 2,285,689 A * 6/1942 Tullis ..... F23D 91/02 239/373
2,515,518 A * 7/1950 Knoy et al. ..... 431/107
2,638,085 A * 5/1953 Guedon ..... F21L 19/00 126/209
3,529,911 A * 9/1970 Townsend ..... F21L 19/00 431/107
3,773,458 A 11/1973 Spotts
3,817,684 A * 6/1974 Sell ..... F23Q 2/16 222/3
3,843,311 A * 10/1974 Nelson ..... F23Q 7/08 431/109
3,941,554 A * 3/1976 Curtis ..... F21S 13/00 137/505.42
RE29,457 E * 10/1977 Hastings ..... F21L 19/00 126/38
4,172,275 A * 10/1979 Caverio ..... F21L 19/00 362/159
4,392,819 A 7/1983 Ahn
4,535,390 A * 8/1985 Curtis ..... F21V 7/18 362/159
4,599,683 A * 7/1986 Beckham ..... F21L 19/00 362/166
5,639,231 A * 6/1997 May ..... F21H 1/00 431/100
5,902,100 A * 5/1999 Long ..... F23Q 9/08 431/107
6,439,223 B1 8/2002 Draper
6,688,877 B1 2/2004 Draper
6,863,526 B1 * 3/2005 Draper ..... F21L 19/00 417/553
6,887,071 B1 5/2005 Draper
7,568,911 B1 8/2009 Draper
2004/0209210 A1 * 10/2004 Long ..... F21H 1/00 431/111
2005/0053885 A1 * 3/2005 Kuo ..... F23K 5/22 431/344
2005/0213216 A1 * 9/2005 May ..... F21L 19/00 359/612

* cited by examiner

FIG. 6
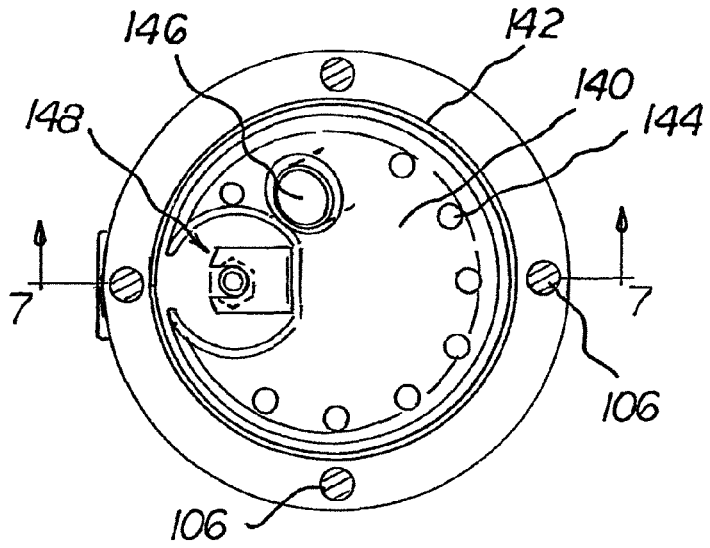
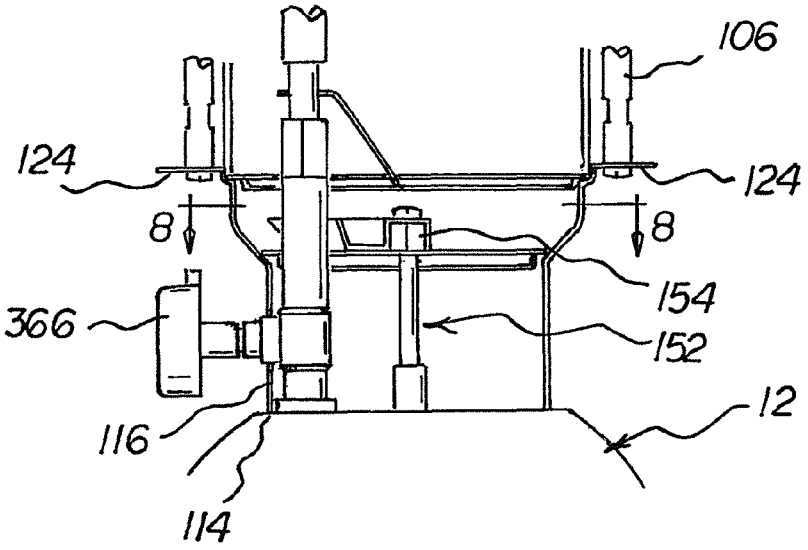
FIG. 7

FIG. 8
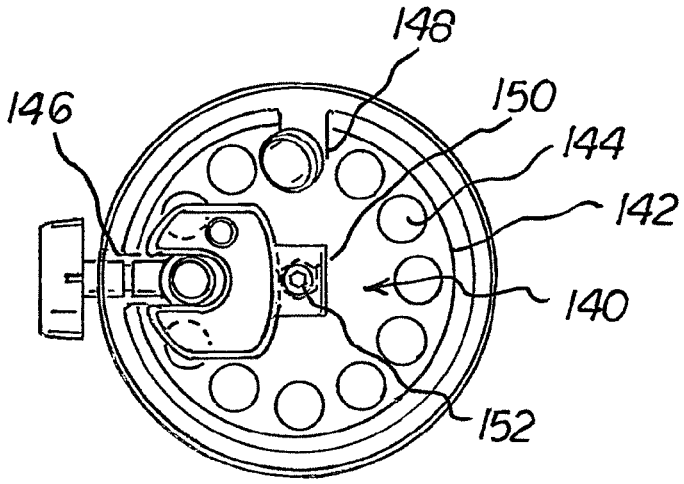
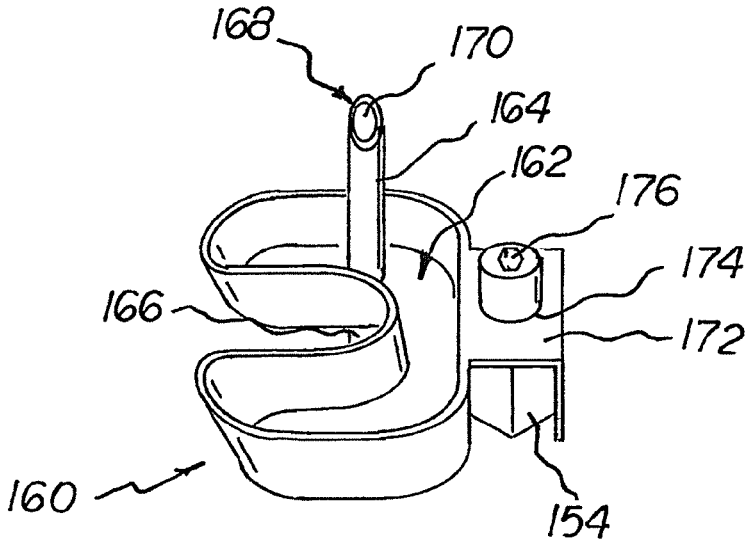
FIG. 9

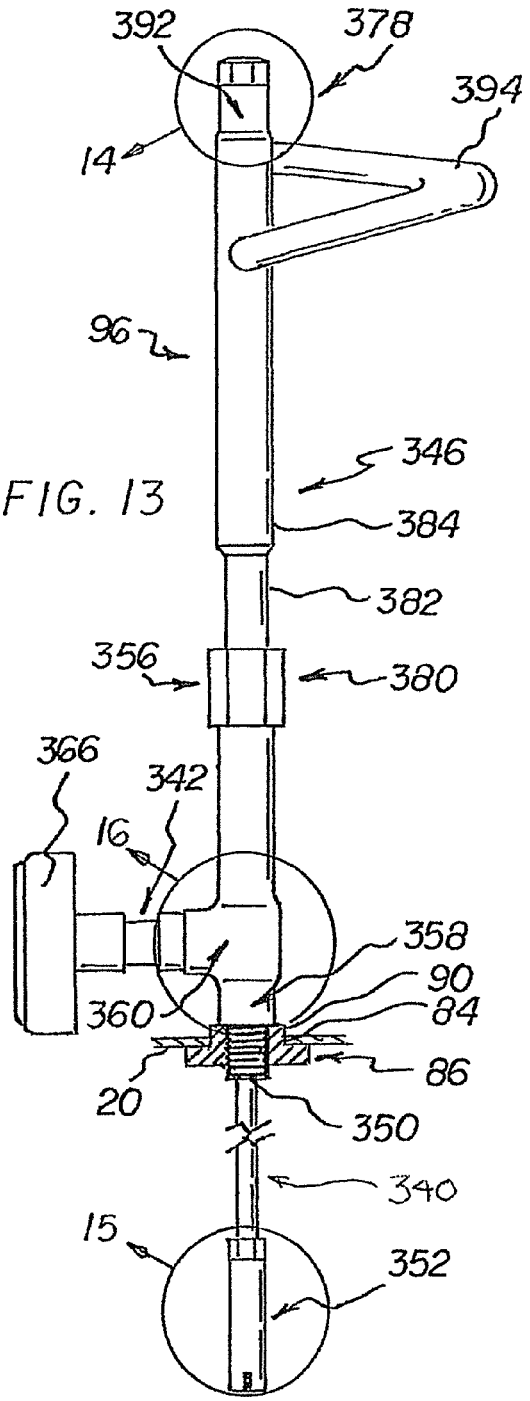
FIG. 13
FIG. 14
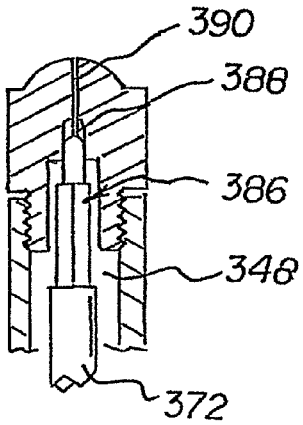
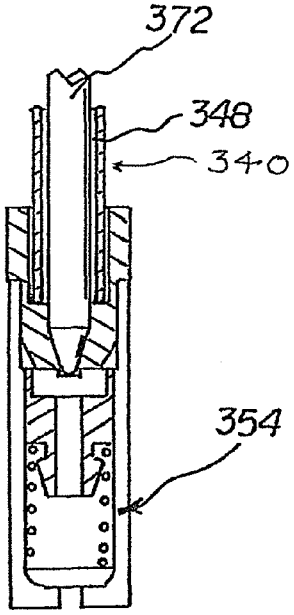
FIG. 15

FIG. 16
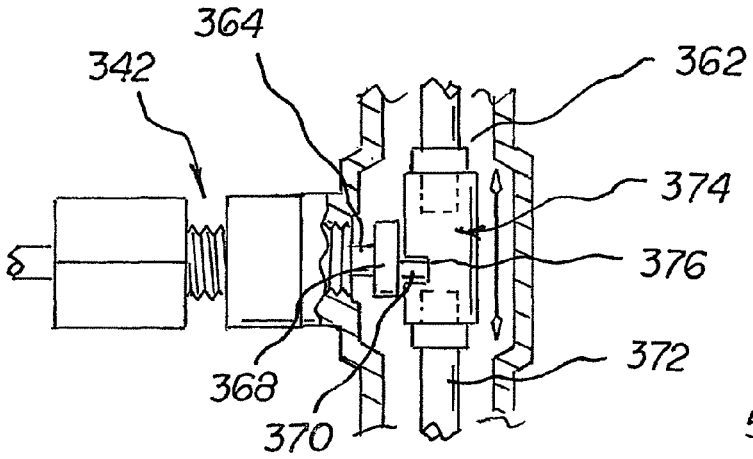
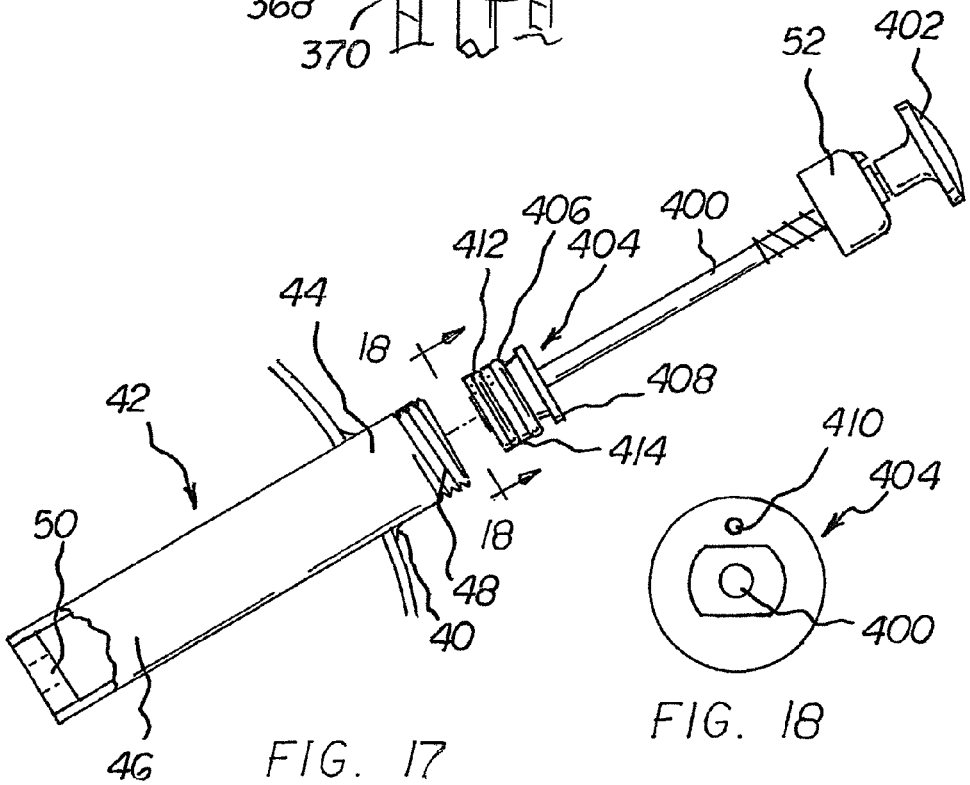
FIG. 17
FIG. 18

FIG. 19
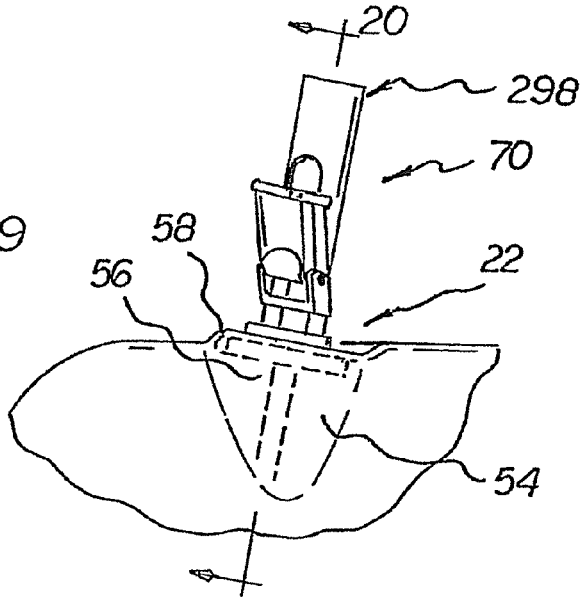
FIG. 20
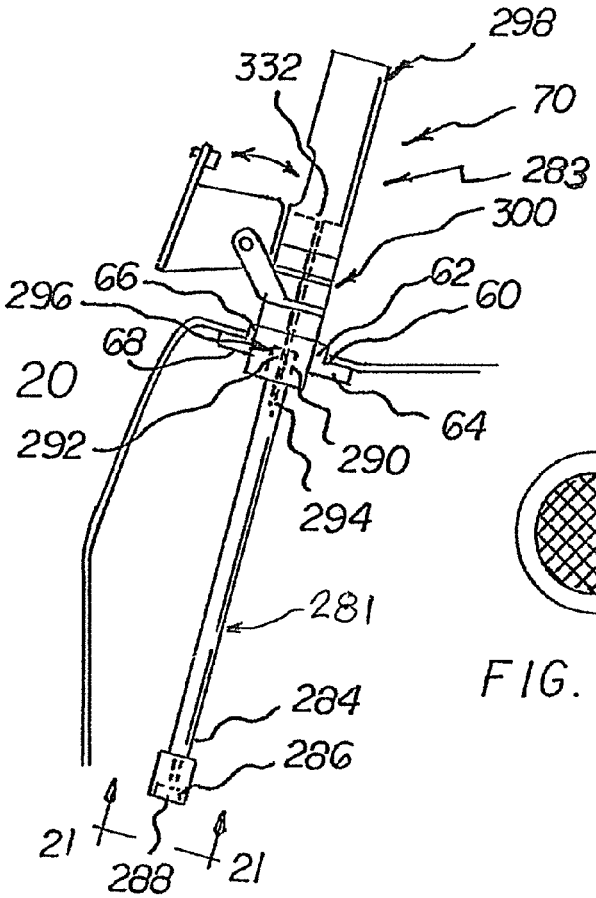
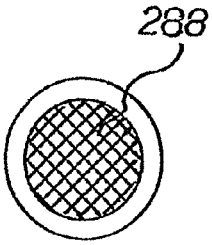
FIG. 21

FIG. 22
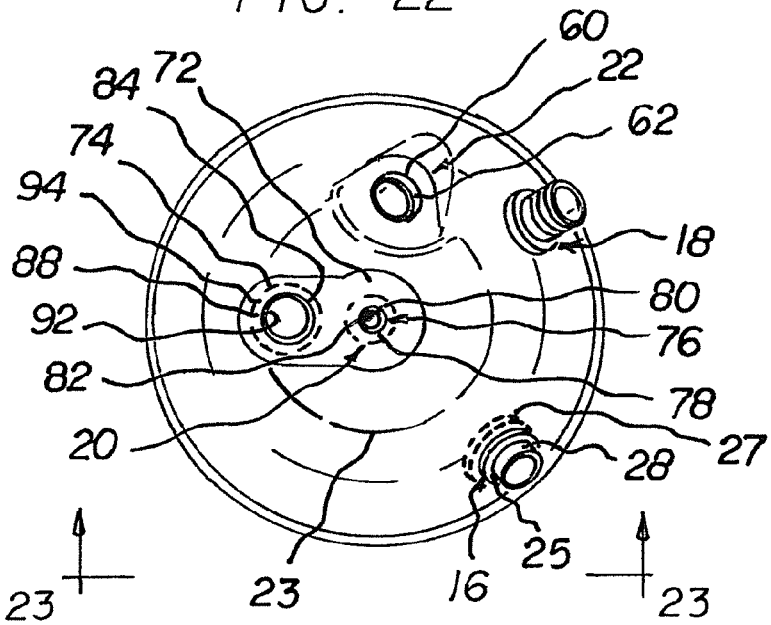
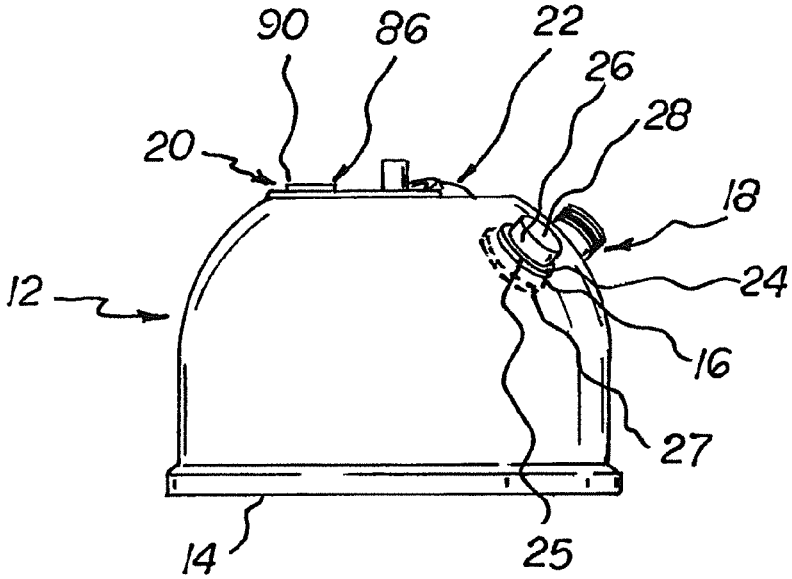
FIG. 23

MULTI-FUEL LANTERN

BACKGROUND OF THE INVENTION

1. Field of the Invention

The present invention relates to a multi-fuel lantern and more particularly pertains to an improvement in the configuration of a lantern to increase efficiency.

2. Description of the Prior Art

The use of liquid fuel lanterns is known in the prior art. More specifically, liquid fuel lanterns previously devised and utilized for the purpose of utilizing liquid fuels to provide light and heat are known to consist basically of familiar, expected, and obvious structural configurations, notwithstanding the myriad of designs encompassed by the crowded prior art which has been developed for the fulfillment of countless objectives and requirements.

While the prior art devices fulfill their respective, particular objectives and requirements, the prior art does not describe a multi-fuel lantern that is of a configuration which is more efficient.

In this respect, the multi-fuel lantern, according to the present invention, substantially departs from the conventional concepts and designs of the prior art, and in doing so provides an apparatus primarily developed for the purpose manufacturing a lantern which is more efficient, both in manufacture and in use.

Therefore, it can be appreciated that there exists a continuing need for a new and improved multi-fuel lantern which is more efficient. In this regard, the present invention substantially fulfills this need.

SUMMARY OF THE INVENTION

In view of the foregoing disadvantages inherent in the known types of liquid fuel lanterns now present in the prior art, the present invention provides an improved multi-fuel lantern. As such, the general purpose of the present invention, which will be described subsequently in greater detail, is to provide a new and improved multi-fuel lantern which has all the advantages of the prior art and none of the disadvantages.

It should be understood that any reference to "multi-fuel" refers to liquid fuels, and not gas fuels, such as propane or butane. Commonly used "liquid fuels" includes, but is not limited to, kerosene, gasoline, diesel, bio diesel, methanol, and jet fuel.

To attain the advantages of the prior art, while avoiding the disadvantages, the present invention essentially comprises a lantern having several components, in combination.

There is first a tank. The tank has a generally hemispherical upper outside wall and a lower base. The upper outside wall of the tank has a filling spout portion, a pump portion, an outflow hole portion, and an igniter aperture portion.

The tank lower base is formed in a generally planar configuration, with the tank base and the upper outside tank wall being coupled to each other.

The filling spout portion of the tank is formed by a generally rounded raised area of the outside wall of the tank. A tank filling spout plug, having a flange, is coupled to the filling spout portion of the tank. A filling spout is coupled to the fliing spout plug.

By "coupled" is meant that the article or structure referred to is joined, either directly, or indirectly, to another article or structure. By "indirectly joined" is meant that there may be an intervening article or structure imposed between the two articles which are "coupled". "Directly joined" means that the two articles or structures are in contact with one another or are essentially continuous with one another.

The tank filling spout has an outer male threaded end and an inner end. The filling spout has an associated filling spout cap. The filing spout cap has a pressure gauge, a pressure release screw, and pressure release hole.

The pump portion of the tank outside wall has an outwardly directed lip, with a pump stub coupled thereto. The pump stub has a round hollow tubular configuration with an outer end and an inner end. The outer end of the pump stub has a male thread and the inner end of the pump stub has a check valve. The outer end of the pump stub is configured to mate with, and be received by, a pump end cap.

The igniter aperture portion of the upper outside wall of the tank has a raised generally triangular configuration, with right side, a left side, and an angled top. The top of the tank igniter aperture portion is angled to the right and inwardly relative to a bottom to top central axis of the lantern. The tank igniter aperture portion has an igniter subassembly hole therein, with the igniter subassembly hole having an associated igniter plug therein. The igniter plug has an inner end and an outer end. The outer end of the igniter plug is sized to fit within the igniter subassembly hole of the aperture portion of the tank. The inner end of the igniter plug has a outwardly disposed flange. The igniter plug female thread receives and mates with an igniter subassembly which is coupled thereto.

The outflow hole portion of the tank outside wall has a raised oblong configured area, with a central part and an outward part. The central part of the outflow hole portion has an upwardly projecting round solid tubular stud. The stud has an upper end and a lower end. The upper end of the stud has a threaded recess therein.

The outward part of the outflow hole portion has an outflow hole therein. The outflow hole of the outward part of the outflow hole portion has an associated outflow plug therein. The outflow plug has an inner end and an outer end. The outer end has a round tubular configuration. The inner end of the igniter plug has an outwardly disposed flange. The outflow plug female thread receives and mates with an outflow subassembly, which is coupled thereto.

Next, there is a chimney. The chimney has lower skirt, an upper sleeve, and a plurality of connecting tubes. The lower skirt has a lower portion and an upper portion. The lower portion is continuous with the upper portion. The lower portion has a lower rim. The lower rim has a lip, with a control knob recess therein. The lower portion has an outflow subassembly recess. The outflow subassembly recess has a hole therein.

The lower portion of the chimney has a plurality of D-shaped air holes therethrough. The upper portion of the chimney having a plurality of D-shaped air holes therethrough. The upper portion has an outwardly oriented lip, with the lip having a plurality of connecting tube screw holes therethrough, The upper sleeve of the chimney having an inwardly directed lip with the sleeve lip having a plurality of connecting tube screw holes therethrough. The upper sleeve of the chimney has a pair of like configured handle mounting blocks coupled thereto.

There are four connecting tubes. Each connecting tube has a first end and a second end, with a length therebetween. The first end of each connecting tube has a female threaded recess therein, and the second end of each connecting tube has a female threaded recess therein. The connecting tubes couple the upper portion of the lower chimney skirt and the inwardly directed lip of the upper sleeve of the chimney.

There is a handle. The handle is coupled to the upper sleeve of the chimney. The handle has a generally elongated curved configuration.

There is a heat shield. The heat shield has a generally disc-like configuration, with an upwardly directed lip and a plurality of holes theretherough. The heat shield has an igniter recess therein and an outflow recess therein. The heat shield has a centrally located attaching hole therethrough.

Next, there is a central assembly screw. The central assembly screw has a threaded first end and a nut, hexagonal, second end. The nut second end has a female threaded recess therein. The central assembly screw passes through the centrally located attaching hole of the heat shield and couples the heat shield and chimney to the upper outside wall of the tank.

There is an ignition bowl. The ignition bowl has a generally U-shaped configuration, with a recess therein. The ignition bowl has a tubular stack. The tubular stack has a closed lower end and an open beveled upper end. The stack forms an open ended recess therein. The ignition bowl has a mounting tab coupled thereto. The mounting tab has a mounting tab hole therethrough. The mounting tab has an associated mounting tab screw, with the mounting tab screw configured to be threadedly received by the nut second end female threaded recess of the central assembly screw.

There is a glass chimney tube. The glass chimney tube is fabricated of a heat resistant glass, such as borosilicate glass. The glass chimney tube has an upper end and a lower end, with a length therebetween. The glass chimney tube has a round hollow tubular configuration. The lower end of the glass chimney tube couples to the upper portion of the lower skirt of the chimney. The upper end of the glass chimney tube is located adjacent the chimney sleeve. The glass chimney tube located between the plurality of connecting tubes.

There is a mixing subassembly. The mixing subassembly has a housing and a fuel flow tube. The mixing subassembly housing has a lower end and an upper end. The lower end has an outwardly directed flange. The flange has a pair of screw holes therethrough. The flange has a rounded slot therein and a P-shaped slot therein. The upper end of the housing has a lower cross brace.

The lower cross brace has a first end comprising a tab and a second end having a rounded slot therein. The lower cross brace has a centrally located fuel line hole. The upper end of the housing has a lower cross brace mounting slot therethrough. The lower cross brace first end passes through the lower cross brace mounting slot of the upper end of the housing.

The upper end of the housing has an inwardly directed fuel mixture recess, with the recess having an upper end and a lower end. The lower end of the fuel mixture recess has an outflow subassembly hole therein. The upper end of the fuel mixture recess has a fuel line hole therein.

The housing has an upper cross brace having a first end and a second end. The upper cross brace has a centrally located fuel line hole therethrough. The first end of the upper cross brace has a fuel line hole there through. The second end of the upper cross brace has an associated fuel line clamp. The fuel line clamp has a compressing screw and a compressing screw mount.

Next, there is a fuel line. The fuel line has a hollow J-shaped tubular configuration with a short outer portion and a long inner portion. The short outer portion of the fuel line has an end. The end of the short outer portion of the fuel line is located in the fuel line hole of the upper end of the fuel mixture recess. The end of the short outer portion of the fuel line is also located in the fuel line hole of the first end of the upper cross brace. The short outer portion of the fuel line passes upwards and turns in a U-shape to be continuous with the long inner portion of the fuel line.

The long inner portion of the fuel line is directed downward through the centrally located fuel line hole of the upper cross brace and through the centrally located fuel line hole of the lower cross brace. The long inner portion of the fuel line has a male threaded end.

The mixing subassembly is coupled with the chimney sleeve.

There is a nozzle. The nozzle has a first end, a second end, with a length therebetween. The first of the nozzle has a female thread therein. The female thread of the nozzle is sized to mate with, and receive, the male thread of the end of the long inner portion of the fuel line. The second end of the nozzle has an end screen. The end screen is crimped into the second end of the nozzle. The length of the nozzle has a mantle mounting groove therein.

A mantle is coupled to the nozzle groove.

There is a chimney cap. The chimney cap has a closed upper end and an open lower end. The lower end has a downwardly extending lip. The chimney cap lower end lip has a pair of oppositely located recesses therein.

The lower end of the chimney cap has a plurality of D-shaped air holes therein. The upper end of the chimney cap has a plurality of D-shaped air holes therein.

The igniter subassembly has a lower feed tube and an upper burning tube. The lower feed tube has a lower end, with an opening therein, and an upper end, with an opening therein. There is a continuous passage through the lower end of the feed tube and the upper end of the feed tube.

The upper burning tube has a lower end, an upper end, and an intermediate section therebetween. The lower end of the upper burning tube is coupled to the upper end of the lower feed tube. The lower end of the upper burning tube is sized to be mated with, and received by, the outer end of the outflow plug.

The lower end of the upper burning tube has an exterior fixed hexagonal nut configuration.

The intermediate section of the upper burn tube has an exterior male thread and an associated extinguisher locking nut. The intermediate section of the upper burning tube has an extinguisher. The extinguisher has mounting portion with the mounting portion having a hole therethrough. The mounting portion of the extinguisher has a pair of generally parallel tabs. The extinguisher has a rotatable member having a thumb lever and an occluder. The intermediate section of the upper burning tube has a passageway therethrough. The intermediate section passageway communicates with, and continuous with, the passageway of the lower feed tube.

The upper end of the upper burning tube comprises a tube with an internal female thread which is sized to be mated to, and receive by, the exterior male thread of the intermediate section of the upper burning tube. The upper end of the upper burning tube has a free top end and a coupled lower end, with the coupled lower end having a side opening therein. The side opening is sized to allow the passage of the extinguisher therethrough. The lower end of the upper burning tube has a pair of air holes therein. The lower end of the upper burning tube has a punch hole therein. The punch hole is continuous with the passageway of the intermediate section of the burning tube.

The outflow subassembly has a feed tube, a control valve subassembly, and an upper heating tube. The feed tube has a passageway therethrough. The feed tube has an upper end and a lower end. The lower end of the feed tube has a spring loaded push valve.

The control valve subassembly has a generally T-shaped configuration with an upper end, a lower end, and a side port. The control valve subassembly has a passageway therethrough. The passageway runs from the upper end of the control valve subassembly to the lower end of the control valve subassembly. The control valve subassembly has a rotatable valve shaft, with the valve shaft having a grip coupled thereto. The rotatable valve shaft has an end with a offset pin. The rotatable valve shaft is housed within the side port of the outflow subassembly.

The outflow subassembly has a control pin, with the control pin having an offset pin receiver. The offset pin receiver has a pin hole therein, with the pin hole being sized to mate with, and receive, the offset pin. The rotation of the valve shaft thereby moves the offset pin receiver and the control pin in an upward and downward direction.

The upper heating tube has an upper end and a lower end. The lower end of the upper heating tube has a first external diameter and a second external diameter. The first external diameter is less than the second external diameter. The upper end of the upper heating tube has the second external diameter. The lower end of the upper heating tube mates with, and is coupled to, the upper end of the control valve subassembly. The upper heating tube has a passageway therethrough with the passageway housing the control pin.

The control pin has an uppermost extent, with the uppermost extent forming a needle. The upper end of the upper heating tube has a needle receiver, with the needle receiver mating with, and receiving, the needle of the uppermost extent of the control pin, thereby forming a needle valve. The upper heating tube has a side hollow passageway therethrough. The side passageway forms a loop and is continuous with the passageway of the upper heating tube.

Lastly, the pump comprises the stub, a shaft, a grip, a piston, and the end cap. The piston has at least one O ring and a bevel. A first O ring rides on the bevel. The piston has a pressure releasing hole therein. In the preferred embodiment, the pump has a second sealing O ring, with the second sealing O ring being located in a second sealing O ring groove.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved multi-fuel lantern which has all of the advantages of the prior art liquid fuel lanterns and none of the disadvantages.

It is another object of the present invention to provide a new and improved multi-fuel lantern which may be easily and efficiently manufactured and marketed.

It is further object of the present invention to provide a new and improved multi-fuel lantern which is of durable and reliable constructions.

An even further object of the present invention is to provide a new and improved multi-fuel lantern which is susceptible of a low cost of manufacture with regard to both materials and labor, and which accordingly is then susceptible of low prices of sale to the consuming public, thereby making such multi-fuel lantern economically available to the buying public.

Even still another object of the present invention is to provide a multi-fuel lantern for an improvement in the configuration of a lantern to increase efficiency.

Lastly, it is an object of the present invention to provide a new and improved multi-fuel lantern comprising a tank, a chimney, an ignition bowl, and a chimney tube. There is also a mixing subassembly, a fuel line, a nozzle and a chimney cap. There is an igniter subassembly, an outflow subassembly and a pump. The igniter subassembly is angled to the right, and inward, providing more efficient heating of the outflow subassembly upper heating tube and loop. A outflow tube, which carries the fuel, has two external dimensions, which provides for more efficient fuel heating.

It should be understood that while the above-stated objects are goals which are sought to be achieved, such objects should not be construed as limiting or diminishing the scope of the claims herein made.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is a view taken along line 6-6 of FIG. 1.

FIG. 7 is a view taken along line 7-7 of FIG. 6.

FIG. 8 is a view taken along line 8-8 of FIG. 7.

FIG. 9 is a perspective view of the ignition bowl.

FIG. 13 is a side elevational view of the outflow subassembly.

FIG. 14 is a close up, cross sectional view of circle 14 of FIG. 13.

FIG. 15 is a close up, cross sectional view of circle 15 of FIG. 13.

FIG. 16 is a close up, cross sectional view of circle 16 of FIG. 13.

FIG. 17 is an exploded view of the pump of the preferred embodiment, showing the relationship of the two O rings, one on the beveled portion and one in the groove.

FIG. 18 is a view taken along line 18-18 of FIG. 17. Note the vent hole in the piston.

FIG. 19 is a side elevational view of the igniter subassembly installed in the tank. The igniter plug is shown in phantom, as is the lower feed tube.

FIG. 20 is a view taken along line 20-20 of FIG. 19.

FIG. 21 is a view taken along line 21-21 of FIG. 20.

FIG. 22 is a top plan view of the tank hemispherical upper outside wall. Note the angled orientation of the igniter subassembly aperture.

FIG. 23 is a view taken along line 23-23 of FIG. 22.

The same reference numerals refer to the same parts throughout the various Figures.

DESCRIPTION OF THE PREFERRED EMBODIMENT

Figure 1:
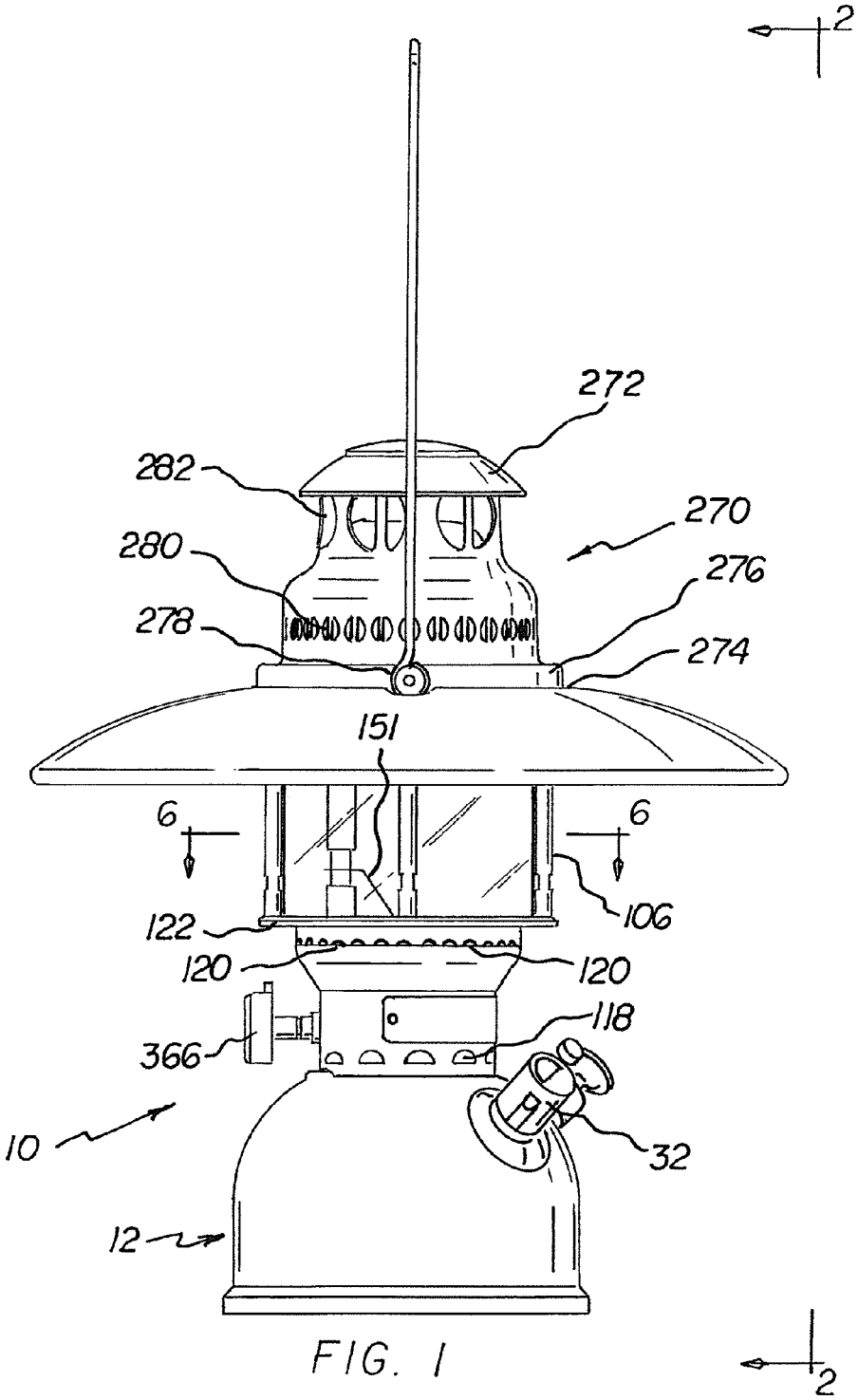
FIG. 1 is an elevational view of the lantern.
Figures 2, 3:
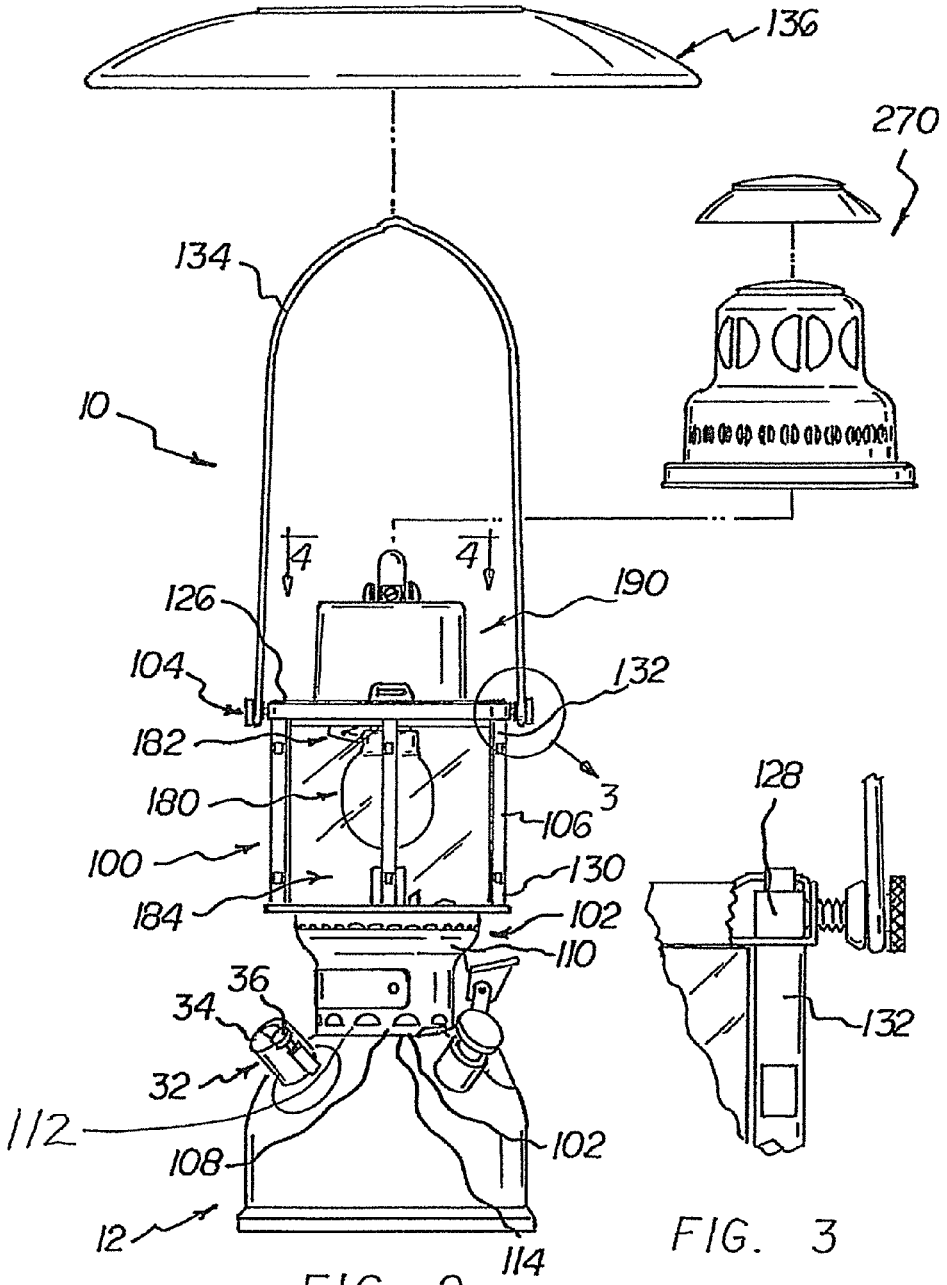
FIG. 2 is a view taken along line 2-2 of FIG. 1.
FIG. 3 is a close up view of circle 3 of FIG. 2.
Figure 4:
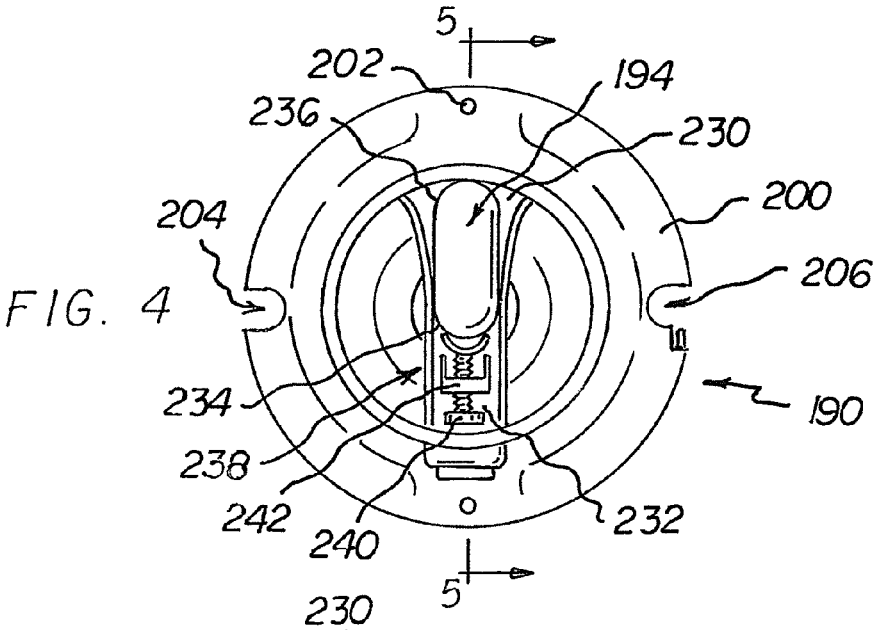
FIG. 4 is a view taken along line 4-4 of FIG. 2.
Figure 5:
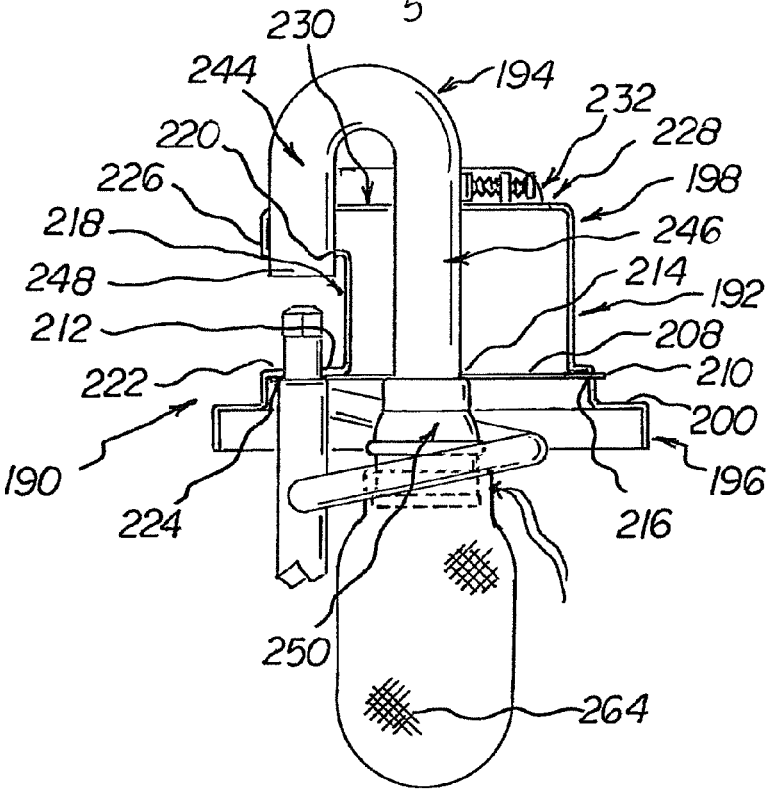
FIG. 5 is a view taken along line 5-5 of FIG. 4.
Figure 10:
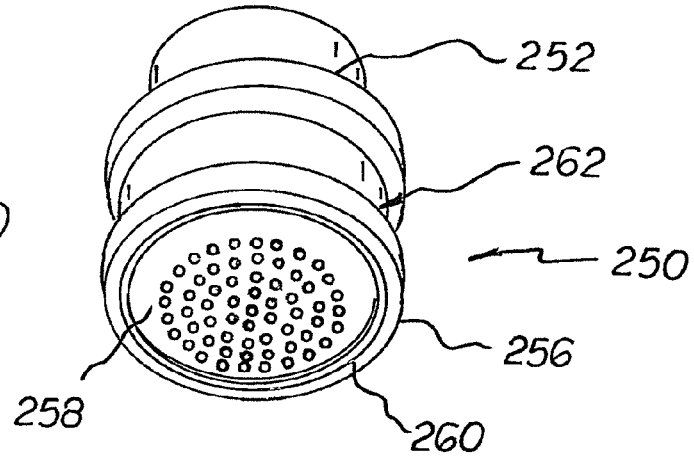
FIG. 10 is a perspective view of the nozzle.
Figure 11:
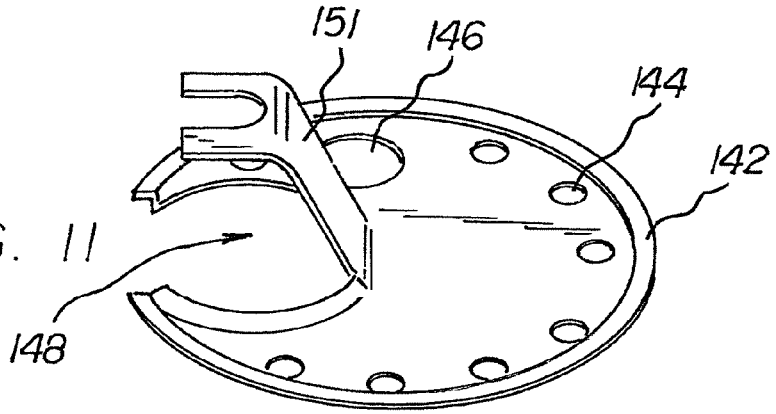
FIG. 11 is a perspective view of a heat shield with a bracket.
Figure 12:
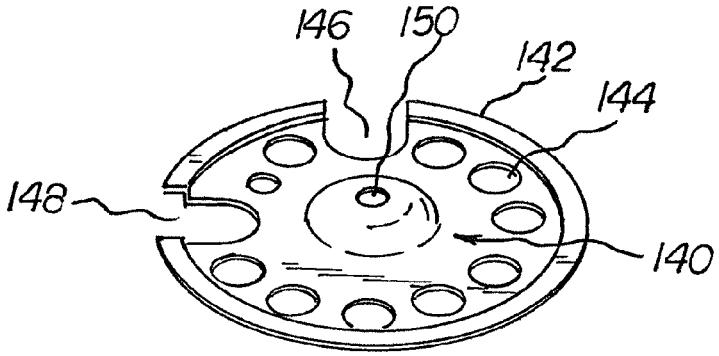
FIG. 12 is a perspective view of the heat shield used in the preferred embodiment.
Figure 24:
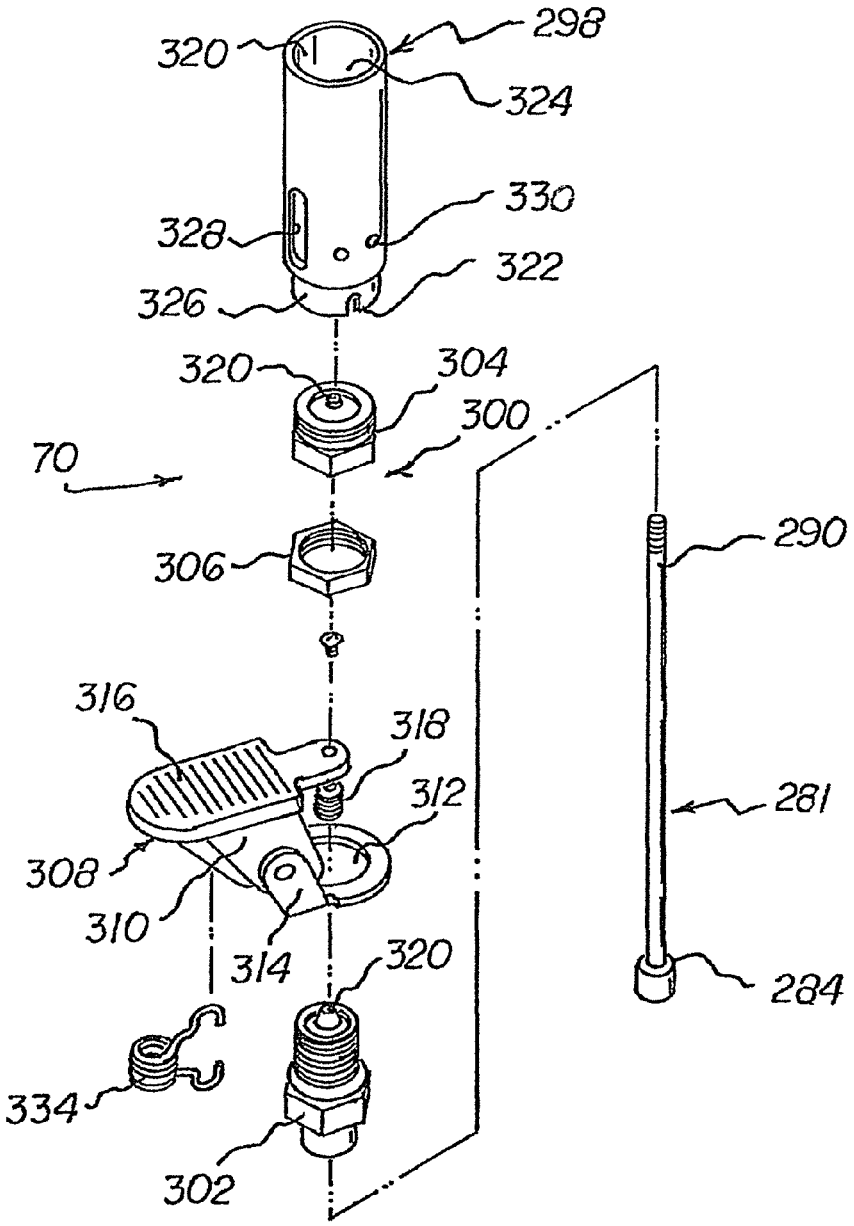
FIG. 24 is an exploded view of the igniter subassembly.

With reference now to the drawings, and in particular to FIG. 1 thereof, the preferred embodiment of the new and improved multi-fuel lantern embodying the principles and concepts of the present invention, and generally designated by the reference numeral 10, will be described.

The present invention, the multi-fuel lantern 10 is comprised of a plurality of components. Such components in their broadest context include a tank, a outflow subassembly, an igniter subassembly and a chimney. Such components are individually configured and correlated with respect to each other so as to attain the desired objective.

A lantern 10 comprising several components, in combination is described. First, there is a tank 12. The tank has a generally hemispherical upper outside wall and a lower base 14. The upper outside wall of the tank has a filling spout portion 16, a pump portion 18, an outflow hole portion 20, an igniter aperture portion 22, and a register groove 23.

The tank lower base is formed in a generally planar configuration, with the tank base and the upper outside tank wall being coupled to each other.

The filling spout portion of the tank is formed by a generally rounded raised area 24 of the outside wall of the tank. A tank filling spout plug 25, having a flange 27, is coupled to the filling pout portion of the tank. A filling spout 26 coupled to the filling spout plug. The tank filling spout has an outer male threaded end 28 and an inner end (not shown). The filling spout has an associated filling spout cap 32. The filling spout cap has a pressure gauge 34, a pressure release screw 36, and pressure release hole (not shown, but well known in the art).

The pump portion of the tank outside wall has an outwardly directed lip 40, with a pump stub 42 coupled thereto. The pump stub has a round hollow tubular configuration with an outer end 44 and an inner end 46. The outer end of the pump stub has a male thread 48 and the inner end of the pump stub has a check valve 50. The outer end of the pump stub is configured to mate with, and be received by, a pump end cap 52.

The igniter aperture portion of the upper outside wall of the tank has a raised triangular configuration, with right side 54, a left side 56, and an angled top 58. The top of the tank igniter aperture portion is angled to the right and inwardly. The tank igniter aperture portion has an igniter subassembly hole 60 therein, with the igniter subassembly hole having an associated igniter plug 62 therein. The igniter plug has an inner end 64 and an outer end 66. The outer end of the igniter plug is sized to fit within the igniter subassembly hole of the aperture portion of the tank. The inner end of the igniter plug has a outwardly disposed flange 68. The igniter plug female thread receives and mates with an igniter subassembly 70 which is coupled thereto.

The outflow hole portion of the tank outside wall has a raised oblong configured area, with a central part 72 and an outward part 74. The central part of the outflow hole portion has an upwardly projecting round solid tubular stud 76. The stud has an upper end 78 and a lower end in the form of a flange 80. The upper end of the stud has a threaded recess 82 therein.

The outward part of the outflow hole portion has an outflow hole 84 therein. The outflow hole of the outward part of the outflow hole portion has an associated outflow plug 86 therein. The outflow plug has an inner end 88 and an outer end 90. The outer end has a round tubular configuration with a female thread 92. The inner end of the igniter plug has an outwardly disposed flange 94. The outflow plug female thread receives and mates with an outflow subassembly 96, which is coupled thereto.

Next, there is a chimney 100. They chimney has lower skirt 102, an upper sleeve 104, and a plurality of connecting tubes 106. The lower skirt has a lower portion 108 and an upper portion 110. The lower portion is continuous with the upper portion. The lower portion has a lower rim 112. The lower rim has a lip 114, with a control knob recess 116 therein. The lower portion has igniter subassembly recess (not shown). The igniter subassembly recess has a hole (not shown) therein.

The lower portion of the chimney has a plurality of D-shaped air holes 118 therethrough. The upper portion of the chimney having a plurality of D-shaped air holes 120 therethrough. The upper portion has an outwardly oriented lip 122, with the lip having a plurality of connecting tube screw holes 124 therethrough, The upper sleeve of the chimney having an inwardly directed lip 126 with the sleeve lip having a plurality of connecting tube screw holes (not shown) therethrough. The upper sleeve of the chimney has a pair of like configured handle mounting blocks 128 coupled thereto.

There are four connecting tubes 106. Each connecting tube has a first end 130 and a second end 132, with a length therebetween. The first end of each connecting tube has a female threaded recess therein (not shown), and the second end of each connecting tube has a female threaded recess (not shown) therein. Each connecting tube has a pair of associated screws (not shown) for assembly. The connecting tubes couple the upper portion of the lower chimney skirt and the inwardly directed lip of the upper sleeve of the chimney.

There is a handle 134. The handle is coupled to the upper sleeve of the chimney. The handle has a generally elongated curved configuration.

There is a reflector 136.

There is a heat shield 140. The heat shield has a generally disc-like configuration, with an upwardly directed lip 142 and a plurality of holes 144 theretherough. The heat shield has an igniter recess 146 therein and an outflow recess 148 therein. The heat shield has a centrally located attaching hole 150 therethrough. In a variation of the heat shield, the centrally located attaching hole may not be in place, as shown in FIG. 6. The heat shield may have, in a variation, a bracket 151 four bracing against the outflow subassembly.

Next, there is a central assembly screw 152. The central assembly screw has a threaded first end (not shown) and a nut, hexagonal, second end 154. The nut second end has a female threaded recess (not shown) therein. The central assembly screw passes through the centrally located attaching hole of the heat shield and couples the heat shield and chimney to the upper outside wall of the tank.

There is an ignition bowl 160. The ignition bowl has a generally U-shaped configuration, with a recess 162 therein. The ignition bowl has a tubular stack 164. The tubular stack has a closed lower end 166 and an open beveled upper end 168. The stack forms an open ended recess 170 therein. The ignition bowl has a mounting tab 172 coupled thereto. The mounting tab has a mounting tab hole 174 therethrough. The mounting tab has an associated mounting tab screw 176, with the mounting tab screw configured to be threadedly received by the nut second end female threaded recess of the central assembly screw.

There is a glass chimney tube 180. The glass chimney tube is fabricated of a heat resistant glass. The glass chimney tube has an upper end 182 and a lower end 184, with a length therebetween. The glass chimney tube has a round hollow tubular configuration. The lower end of the glass chimney tube couples to the upper portion of the lower skirt of the chimney. The upper end of the glass chimney tube is located adjacent the chimney sleeve. The glass chimney tube located between the plurality of connecting tubes.

There is a mixing subassembly 190. The mixing subassembly has a housing 192 and a fuel flow tube 194. The mixing subassembly housing has a lower end 196 and an upper end 198. The lower end has an outwardly directed flange 200. The flange has a pair of screw holes 202 therethrough. The flange has a rounded slot 204 therein and a P-shaped slot 206 therein. The upper end of the housing has a lower cross brace 208. The lower cross brace has a first end comprising a tab 210 and a second end having a rounded slot 212 therein. The cross brace has a centrally located fuel line hole 214. The upper end of the housing has a lower cross brace mounting slot 216 therethrough. The lower cross brace first end passes through the lower cross brace mounting slot of the upper end of the housing. The upper end of the housing has an inwardly directed fuel mixture recess 218, with the recess having an upper end 220 and a lower end 222. The lower end of the fuel mixture recess has an outflow subassembly hole 224 therein. The upper end of the fuel mixture recess has a fuel line hole 226 therein. The housing has an upper cross brace 228 having a first end 230 and a second end 232. The upper cross brace has a centrally located fuel line hole 234 therethrough. The first end of the upper cross brace has a fuel line hole 236 there through. The second end of the upper cross brace has an associated fuel line clamp 238. The fuel line clamp has a compressing screw 240 and a compressing screw mount 242.

The fuel flow tube 194 has a hollow J-shaped tubular configuration with a short outer portion 244 and a long inner portion 246. The short outer portion of the fuel line has an end 248. The end of the short outer portion of the fuel line is located in the fuel line hole of the upper end of the fuel mixture recess. The end of the short outer portion of the fuel line is also located in the fuel line hole of the first end of the upper cross brace. The short outer portion of the fuel line passes upwards and turns in a U-shape to be continuous with the long inner portion of the fuel line. The long inner portion of the fuel line is directed downward through the centrally located fuel line hole of the upper cross brace and through the centrally located fuel line hole of the lower cross brace. The long inner portion of the fuel line has a male threaded end (not shown but well known in the art). The mixing subassembly is coupled with the chimney sleeve.

There is a nozzle 250. The nozzle has a first end 252, a second end 256, with a length therebetween. The first of the nozzle has a female thread (not shown) therein. The female thread of the nozzle is sized to mate with, and receive, the male thread of the end of the long inner portion of the fuel line. The second end of the nozzle has an end screen 258. The end screen is crimped 260 into the second end of the nozzle. The length of the nozzle has a mantle mounting groove 262 therein.

A mantle 264 is coupled to the nozzle groove.

There is a chimney cap 270. The chimney cap has a closed upper end 272 and an open lower end 274. The lower end has a downwardly extending lip 276. The chimney cap lower end lip has a pair of oppositely located recesses 278 therein. The lower end of the chimney cap has a plurality of D-shaped air holes 280 therein. The upper end of the chimney cap has a plurality of D-shaped air holes 282 therein.

The igniter subassembly 70 has a lower feed tube 281 and an upper burning tube 283. The lower feed tube has a lower end 284, with an opening 286 therein, with a screen 288, and an upper end 290, with an opening 292 therein. There is a continuous passage 294 through the lower end of the feed tube and the upper end of the feed tube.

The upper burning tube has a lower end 296, an upper end 298, and an intermediate section 300 therebetween. The lower end of the upper burning tube is coupled to the upper end of the lower feed tube. The lower end of the upper burning tube is sized to be mated with, and received by, the outer end of the outflow plug. The lower end of the upper burning tube has an exterior fixed hexagonal nut 302 configuration. The intermediate section of the upper burn tube has an exterior male thread 304 and an associated extinguisher locking nut 306. The intermediate section of the upper burning tube has an extinguisher 308. The extinguisher has mounting portion 310 with the mounting portion having a hole 312 therethrough. The mounting portion of the extinguisher has a pair of generally parallel tabs 314. The extinguisher has a rotatable member having a thumb lever 316 and an occluder 318. The intermediate section of the upper burning tube has a passageway 320 therethrough. The intermediate section passageway communicates with, and continuous with, the passageway of the lower feed tube. The upper end of the upper burning tube comprises a tube with an internal female thread 322 which is sized to be mated to, and receive by, the exterior male thread of the intermediate section of the upper burning tube. The upper end of the upper burning tube has a free top end 324 and a coupled lower end 326, with the coupled lower end having a side opening 328 therein. The side opening is sized to allow the passage of the extinguisher therethrough. The lower end of the upper burning tube has a pair of air holes 330 therein. The lower end of the upper burning tube has a punch hole 332 therein. The punch hole is continuous with the passageway of the intermediate section of the burning tube. The extinguisher has an associated spring 334 to bias the extinguisher in position.

The outflow subassembly 96 has a feed tube 340, a control valve subassembly 342, and an upper heating tube 346. The feed tube has a passageway 348 therethrough. The feed tube has an upper end 350 and a lower end 352. The lower end of the feed tube has a spring loaded push valve 354. The control valve subassembly has a generally T-shaped configuration with an upper end 356, a lower end 358, and a side port 360. The control valve subassembly has a passageway 362 therethrough. The passageway runs from the upper end of the control valve subassembly to the lower end of the control valve subassembly. The control valve subassembly has a rotatable valve shaft 364, with the valve shaft having a grip 366 coupled thereto. The rotatable valve shaft has an end 368 with a offset pin 370. The rotatable valve shaft is housed within the side port of the outflow subassembly.

The outflow subassembly has a control pin 372, with the control pin having an offset pin receiver 374. The offset pin receiver has a pin hole 376 therein, with the pin hole being sized to mate with, and receive, the offset pin. The rotation of the valve shaft thereby moves the offset pin receiver and the control pin in an upward and downward direction.

The upper heating tube has an upper end 378 and a lower end 380. The lower end of the upper heating tube has a first external diameter 382 and a second external diameter 384. The first external diameter is less than the second external diameter. The upper end of the upper heating tube has the second external diameter. The lower end of the upper heating tube mates with, and is coupled to, the upper end of the control valve subassembly. The upper heating tube has a passageway 348 therethrough with the passageway housing the control pin. The control pin has an uppermost extent 386, with the uppermost extent forming a needle 388. The upper end of the upper heating tube has a needle receiver 390, with the needle receiver mating with, and receiving, the needle of the uppermost extent of the control pin, thereby forming a needle valve 392. The upper heating tube has a side hollow passageway 394 therethrough. The side passageway forms a loop and is continuous with the passageway of the upper heating tube.

Lastly, the pump comprises the stub, a shaft 400, a grip 402, a piston 404, and the end cap. The piston has at least one O ring 406 and a bevel 408. A first O ring rides on the bevel. The piston has a pressure releasing hole 410 therein. The pump has a second sealing O ring 412, with the second sealing O ring being located in a second sealing O ring groove 414.

The nozzle used in this invention is an improvement over the exiting art. Previously nozzle configuration were made of two parts, which were then threaded together. The heat encountered during normal use would break down the thread and eventually the nozzle would fall apart, requiring replacement. The present invention uses a single construction, with the screen then being inserted and crimped into the end of the nozzle.

The outflow subassembly upper heating tube has two external dimensions, as well as a loop. The outside dimensions provide for rapid heating of the vaporized liquid, which, in turn, allows the lantern to ignite in less time than previously. The enlarged loop also contributes to the start-up efficiency of the lantern.

A substantial improvement of this lantern is the providing raised areas in conjunction with the use of internal plugs having a flange on each. The raising of the tank areas allows for easy placement of the flange during the internal welding process. The flange provides for an increased surface area for the weld to be obtained, making a connection with greater surface area and strength.

In previous methods of lantern construction, the attached filling spouts and pumps were held in place with a bracket. The bracket was then left in the tank when the bottom was welded or coupled to the upper hemispherical section. The use of the raised areas in conjunction with the use of flanged plugs eliminates the need for a bracket to hold the components in position during welding. In addition to making a joint which is stronger, the elimination of the bracket by the raised areas and plugs makes the joining more efficient in time and cost.

Another aspect of the lantern, which is an improvement, is the angled orientation of the burning tube and the igniter subassembly, by angling the tank wall to which the igniter subassembly is attached. The angling of the igniter directs the flame toward the loop and the upper heating tube. This increases the efficiency of warming the fuel, allowing the lantern to ignite sooner, and burn more consistently. The angling of the tank wall also allows for more consistency in orientating the igniter subassembly toward the upper heating tube. Previously, when the igniter was placed, it would have to be held in place during welding, with the assembler only guessing at the proper angle. The angling of the tank wall now determines where the igniter will directed, making installation more consistent, and more efficient.

Another improvement is the use of a register groove on the tank hemispherical wall. The register groove allows the lower portion of the lower chimney skirt to fit into the groove, thereby easily aligning the chimney with the tank. The groove also prevents the chimney skirt from being moved along the surface of the hemispherical outside surface of the tank. This allows for easy assembly of the lantern.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A lantern comprising:

a tank having a generally hemispherical upper outside wall and a lower base, the upper outside wall of the tank having a filling spout portion and a pump portion and an outflow hole portion and an igniter aperture portion, the filling spout portion of the tank being formed by a generally rounded raised area of the outside wall of the tank with a tank filling spout coupled thereto;

a chimney having lower skirt with an upper portion and a lower portion, the chimney having an upper sleeve and the chimney having a plurality of connecting tubes, with the chimney coupled to the tank;

an ignition bowl having a generally U-shaped configuration with a recess therein;

a chimney tube having an upper end and a lower end with a length therebetween, the chimney tube being coupled to the chimney;

a mixing subassembly having a housing and a fuel flow tube, the mixing subassembly housing having a lower end and an upper end, the mixing subassembly coupling with the upper sleeve of the chimney;

a fuel line having a hollow J-shaped tubular configuration with a short outer portion and a long inner portion, the short outer portion of the fuel line having an end, the fuel line being coupled to the mixing subassembly;

a nozzle having a first end and a second end with a length therebetween, the nozzle being coupled to the fuel line;

a chimney cap having a closed upper end and an open lower end;

an igniter subassembly coupled to the igniter aperture portion of the tank, the igniter subassembly having a lower feed tube and an upper burning tube, the igniter subassembly lower feed tube having a lower end with an opening therein and an upper end with an opening therein with a continuous passage therethrough from the lower end of the igniter subassembly feed tube to the upper end of the igniter subassembly feed tube, the upper burning tube of the igniter subassembly having a lower end and an upper end and an intermediate section therebetween;

an outflow subassembly coupled to the outflow portion of the tank, the outflow subassembly having an outflow fuel feed tube and a control valve subassembly and an upper heating tube, the fuel feed tube of the outflow subassembly having a passageway therethrough, the fuel feed tube of the outflow subassembly having an upper end and a lower end; and a pump comprising a stub and a shaft and a grip and a piston and the end cap.

2. The lantern as described in claim 1, with the lantern further comprising:

the tank pump portion having an outwardly directed lip with the pump stub coupled thereto;

the igniter aperture portion of the upper outside wall of the tank having a raised triangular configuration with right side and a left side and an angled top;

the lower end of the upper burning tube of the igniter subassembly being coupled to the upper end of the lower feed tube of the igniter subassembly, the lower end of the upper burning tube being sized to be mated with and be received by the igniter subassembly hole plug; and the outflow subassembly upper heating tube having an upper end and a lower end, the lower end of the upper heating tube of the outflow subassembly having a first external diameter and the upper end of the outflow subassembly upper heating tube having a second external diameter, with the first external diameter being less than the second external diameter.

3. The lantern as described in claim 2, with the lantern further comprising:

the tank outflow hole portion having a raised oblong configured area with a central part and an outward part;

the intermediate section of the upper burning tube of the igniter subassembly having a passageway therethrough with the passageway communicating with and being continuous with the passageway of the lower feed tube of the igniter subassembly; and the control valve subassembly having a generally T-shaped configuration with an upper end and a lower end and a side port, the control valve subassembly having a passageway therethrough, with the passageway running from the upper end of the control valve subassembly to the lower end of the control valve subassembly.

4. The lantern as described in claim 3, with the lantern further comprising:

the tank lower base formed in a generally planar configuration with the tank base and the upper outside tank wall being coupled to each other, the central part of the tank outflow hole portion having an upwardly projecting round solid tubular stud having an upper end and a lower end;

the upper sleeve of the chimney having an inwardly directed lip;

at least one connecting tube with each connecting tube having a first end and a second end with a length therebetween; and the lower end of the upper burning tube of the igniter subassembly comprising a tube with an internal female thread sized to be mated with and received by the exterior male thread of the intermediate section of the upper burning tube of the igniter subassembly.

5. The lantern as described in claim 4, with the lantern further comprising:

the tank filling spout having an outer male threaded end and an inner end;

the top of the tank igniter aperture portion being angled to the right and inwardly;

the intermediate section of the upper burning tube of the igniter subassembly having an extinguisher;

the control valve subassembly having a rotatable valve shaft; and the lower end of the upper heating tube mating with and being coupled to the upper end of the control valve subassembly, the upper heating tube having a passageway therethrough with the passageway housing a control pin, the control pin having an uppermost extent with the uppermost extent forming a needle.

6. The lantern as described in claim 5, with the lantern further comprising:

the upper end of the tank central part outflow hole portion stud having a threaded recess therein;

the upper chimney sleeve lip having a plurality of connecting tube screw holes therethrough;

the lower end of the chimney tube being coupled to the upper portion of the lower skirt of the chimney and the upper end of the chimney tube being located adjacent the chimney sleeve;

the second end of the nozzle having an end screen, the upper end of the upper burning tube of the igniter subassembly having a free top end and a coupled lower end with the coupled lower end having a side opening therein, the side opening being sized to allow the passage of at least part of the extinguisher therethrough, the lower end of the upper burning tube of the igniter subassembly having at least one air hole therein and a punch hole therein, the punch hole being continuous with the passageway of the upper end of the lower feed tube of the igniter subassembly and the intermediate section of the burning tube of the igniter subassembly; and the control valve having a rotatable shaft with the rotatable shaft having an end with an offset pin, the rotatable valve shaft being housed within the side port of the outflow subassembly.

7. The lantern as described in claim 6, with the lantern further comprising:

the filling spout having an associated filling spout cap having a pressure gauge and a pressure release screw and pressure release hole;

the tank igniter aperture portion having an igniter subassembly hole therein with the igniter subassembly hole having an associated igniter plug therein;

the outward part of the outflow hole portion of the tank having an outflow hole therein;

the lower skirt of the chimney having a lower portion and an upper portion with the lower portion being continuous with the upper portion;

a heat shield having a generally disc-like configuration with the heat shield having an upwardly directed lip and a plurality of holes theretherough, the heat shield having an igniter recess therein and an outflow recess therein;

the length of the nozzle having a mantle mounting groove therein;

the extinguisher of the igniter subassembly having mounting portion having a hole therethrough and a pair of generally parallel tabs;

the outflow subassembly having a control pin with the control pin having an offset pin receiver, the offset pin receiver having a pin hole therein with the pin hole being sized to mate with and receive the offset pin, the rotation of the valve shaft thereby moving the offset pin receiver and the control pin in an upward and downward direction; and the upper end of the upper heating tube of the outflow subassembly having a needle receiver with the needle receiver mating with and receiving the needle of the uppermost extent of the control pin of the outflow subassembly, thereby forming a needle valve.

8. The lantern as described in claim 7, with the lantern further comprising:

the pump stub having a round hollow tubular configuration with an outer end and an inner end, the outer end of the pump stub having a male thread and the inner end of the pump stub having a check valve;

the lower portion of the lower skirt of the chimney having a lower rim with the lower rim having a lip with a control knob recess therein;

the upper sleeve of the chimney having a pair of like configured handle mounting blocks coupled thereto;

the first end of each connecting tube having a female threaded recess therein and the second end of each connecting tube having a female threaded recess therein;

the heat shield having a centrally located attaching hole therethrough;

a central assembly screw having a threaded first end and a nut second end, the nut second end having a female threaded recess therein, the central assembly screw passing through the centrally located attaching hole of the heat shield and coupling the heat shield and chimney to the upper outside wall of the tank; and the upper end of the housing of the mixing subassembly having a lower cross brace with the lower cross brace having a first end comprising a tab and a second end having a rounded slot therein.

9. The lantern as described in claim 8, with the lantern further comprising:

the igniter plug having an inner end and an outer end;

the outflow hole of the outward part of the outflow hole portion having an associated outflow plug therein;

the connecting tubes coupling the upper portion of the lower chimney skirt and the inwardly directed lip of the upper sleeve of the chimney;

the ignition bowl having a tubular stack with the tubular stack having a closed lower end and an open beveled upper end, the stack forming an open ended recess therein;

the chimney tube being located between the connecting tubes;

the lower end of the mixing subassembly having an outwardly directed flange, with the flange having a pair of screw holes therethrough;

the cross brace of the upper end of the housing of the mixing subassembly having a centrally located fuel line hole;

the extinguisher of the igniter subassembly having a rotatable member having a thumb lever and an occluder; and the upper heating tube having a side hollow tubular passageway therethrough with the passageway forming a loop and the loop being continuous with the passageway of the upper heating tube.

10. The lantern as described in claim 9, with the lantern further comprising:

the outer end of the pump stub being configured to mate with and be received by a pump end cap;

the ignition bowl having a mounting tab coupled thereto, the ignition bowl mounting tab having a mounting tab hole therethrough;

the upper end of the mixing subassembly housing having a lower cross brace mounting slot therethrough with the lower cross brace having a first end and the lower cross brace first end passing through the lower cross brace mounting slot of the upper end of the housing; and the lower end of the chimney cap having a downwardly extending lip.

11. The lantern as described in claim 10, with the lantern further comprising:

the igniter plug having an outer end with the outer end of the igniter plug being sized to fit within the igniter subassembly hole of the aperture portion of the tank;

the outflow plug having an inner end and an outer end;

the ignition bowl mounting tab having an associated mounting tab screw with the mounting tab screw being configured to be threadedly received by the nut second end of the central assembly screw;

the upper end of the mixing subassembly housing having an inwardly directed fuel mixture recess having an upper end and a lower end, with the lower end of the fuel mixture recess having an outflow subassembly hole therein and the upper end of the fuel mixture recess having a fuel line hole therein;

the lip of the lower end of the chimney cap having a pair of oppositely located recesses therein; and the intermediate section of the upper burning tube of the igniter subassembly having an exterior male thread and an associated extinguisher locking nut.

12. The lantern as described in claim 11, with the lantern further comprising:

the lower portion of the lower skirt of the chimney having a plurality of D-shaped air holes therethrough;

the mixing subassembly housing having an upper cross brace having a first end and a second end, the upper cross brace having a centrally located fuel line hole therethrough and the first end of the upper cross brace having a first end fuel line hole there through;

the end of the short outer portion of the fuel line being located in the fuel line hole of the upper end of the fuel mixture recess of the mixing subassembly and the fuel line hole of the first end of the upper cross brace, the short outer portion of the fuel line passing upwards and turning in a U-shape to be continuous with the long inner portion of the fuel line, the long inner portion of the fuel line being directed downward through the centrally located fuel line hole of the upper cross brace and through the centrally located fuel line hole of the lower cross brace; and the pump piston having at least one O ring and a bevel, with an O ring riding on the bevel.

13. The lantern as described in claim 12, with the lantern further comprising:

the outer end of the igniter plug being a round tubular configuration and the inner end of the igniter plug having an outwardly disposed flange;

the lower skirt of the upper portion of the chimney having a plurality of D-shaped air holes therethrough with the lower skirt upper portion of the chimney having an outwardly oriented lip, with the lip having a plurality of connecting tube screw holes therethrough;

the upper cross brace second end having the fuel line clamp with the fuel line clamp having a compressing screw and a compressing screw mount; and the pump piston having a pressure releasing hole therein.

14. The lantern as described in claim 13, with the lantern further comprising:

a handle coupled to the upper sleeve of the chimney, the handle having a generally elongated curved configuration;

the chimney tube having a round hollow tubular configuration;

the long inner portion of the fuel line having a male threaded end;

the first end of the nozzle having a female thread therein, the female thread of the nozzle being sized to mate with and receive the male thread of the end of the long inner portion of the fuel line; and the lower end of the fuel feed tube having a spring loaded push valve.

15. The lantern as described in claim 14, with the lantern further comprising:

the chimney tube being transparent;

the igniter plug female thread receiving and being mated with an igniter subassembly which is coupled thereto;

the outflow plug female thread receiving and being mated with an outflow subassembly which is coupled thereto;

the transparent chimney tube being fabricated of a heat resistant material;

the flange of the lower end of the mixing subassembly having a rounded slot therein and a P-shaped slot therein;

the nozzle end screen being crimped into the second end of the nozzle;

a mantle coupled to the nozzle groove;

the lower end of the chimney cap having a plurality of D-shaped air holes therein, the upper end of the chimney cap having a plurality of D-shaped air holes therein;

the lower end of the upper burning tube of the igniter subassembly having an exterior fixed hexagonal nut configuration;

the control valve subassembly shaft having a grip coupled thereto; and the pump has a second sealing O ring with the sealing O ring being located in a second sealing O ring groove.

* * * * *